United States Patent [19]

Straitz, III

[11] 4,116,618

[45] Sep. 26, 1978

[54] FLAME RETENTION APPARATUS FOR FLARES

[75] Inventor: John F. Straitz, III, Meadowbrook, Pa.

[73] Assignee: Combustion Unlimited Incorporated, Elkins Park, Pa.

[21] Appl. No.: 815,100

[22] Filed: Jul. 13, 1977

[51] Int. Cl.[2] ..... F23D 13/20

[52] U.S. Cl. ..... 431/202; 239/404; 239/406; 239/463

[58] Field of Search ..... 239/463, 402, 403, 406, 239/404; 431/202, 185, 284

[56] References Cited

U.S. PATENT DOCUMENTS

| | | | |
|---|---|---|---|
| 1,740,985 | 12/1929 | Irish | 431/184 |
| 3,822,985 | 7/1974 | Straitz | 431/284 |
| 3,824,073 | 7/1974 | Straitz | 431/202 |
| 3,995,986 | 12/1976 | Straitz | 431/202 |

*Primary Examiner*—Carroll B. Dority, Jr.

*Attorney, Agent, or Firm*—Zachary T. Wobensmith, 2nd; Zachary T. Wobensmith, III

[57] ABSTRACT

A flame retention apparatus for flare stacks for waste combustible gases is provided which includes fixed mounted guide vanes mounted at the top of the tubular stack and preferably spaced around the interior of the stack, the guide vanes having inclined or tilted terminal ends to impart a swirling or vortex action to a substantial portion of the waste gas exiting from the stack, and preferably with one or more teeth to impart added turbulence to the swirling portion of the waste gas.

4 Claims, 6 Drawing Figures

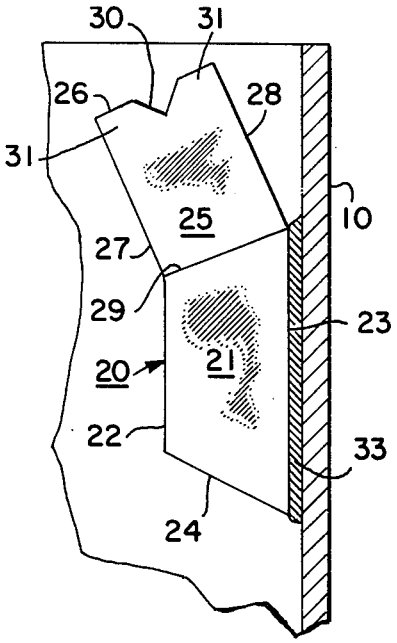
FIG. 3
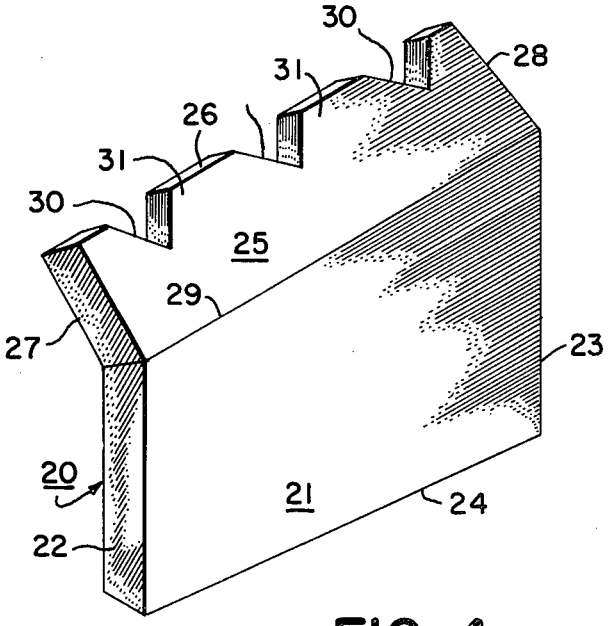
FIG. 4
FIG. 6
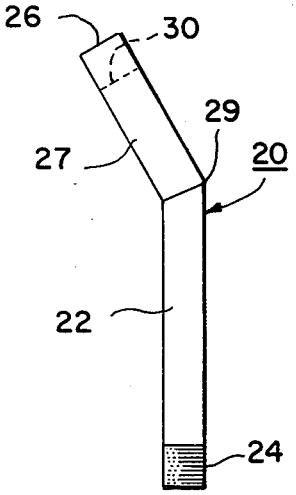
FIG. 5
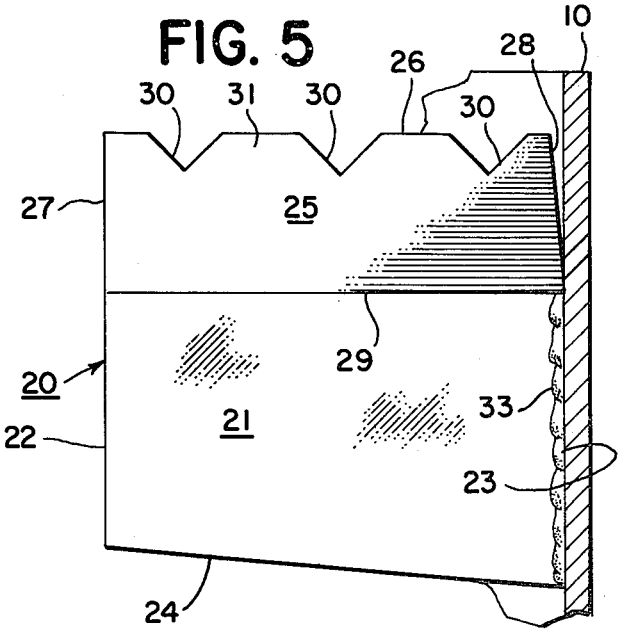

FLAME RETENTION APPARATUS FOR FLARES

BACKGROUND OF THE INVENTION

1. Field of the Invention

This invention relates to flame retention apparatus for flare stacks for waste combustible gas.

2. Description of the Prior Art

Flare stacks, particularly because of their height, have their upper ends exposed to wind which diverts the flame, if the stack is operating, depending on the wind velocity.

In order to prevent extinguishing of the flame at high wind velocities it has heretofore been proposed to provide a ring at the top of a flare stack having a central opening and with a plurality of openings for discharge close to the outer periphery of portions of the waste gas for burning. While such rings are usually separately constructed and secured to the top of the stack if the stack is small they may be integral.

Examples of such rings are shown in the U.S. Patents to Zink et al., Nos., 2,779,399 and 3,134,424, Reed, 3,697,231 and my prior U.S. Pat. No. 3,822,984.

Such rings are costly to manufacture, provide a restriction which reduces the flow of waste gas and produce a very hot zone at and below their location which results because of the weight of the ring and its rigidity in ring cracking and failure. Such rings also have other objectionable characteristics which seriously reduce their effectiveness.

SUMMARY OF THE INVENTION

In accordance with the invention apparatus is provided for flame retention at the discharge end of a flare stack in a simple but effective manner comprising guide vanes around the periphery of the stack with tilted or inclined terminal ends to impart a swirling or vortex action to a substantial portion of the waste gas exiting from the stack; the vanes preferably having a plurality of teeth to impart added turbulence to the swirling portion of the waste gas.

It is the principal object of the invention to provide simple but effective flame retention apparatus for waste combustible gas discharging from a flare stack.

It is a further object of the invention to provide apparatus of the character aforesaid which provides better flame stability with smoother and greater flow than has heretofore been available.

It is a further object of the invention to provide apparatus for flame retention of a flare stack which will have low noise output.

It is a further object of the invention to provide apparatus for flame retention of a flare stack which will be less costly and easier to manufacture and which will have a longer life than the apparatus heretofore available for flame retention.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which:

FIG. 3 is a fragmentary view of one form of guide vane shown as attached to the stack by welding;

FIG. 4 is a perspective view of another form of guide vane prior to attachment;

FIG. 5 is a fragmentary view showing the attachment of the vane of FIG. 4 by welding; and FIG. 6 is an end elevational view of the vanes shown in FIGS. 3, 4 and 5.

Figure 1:
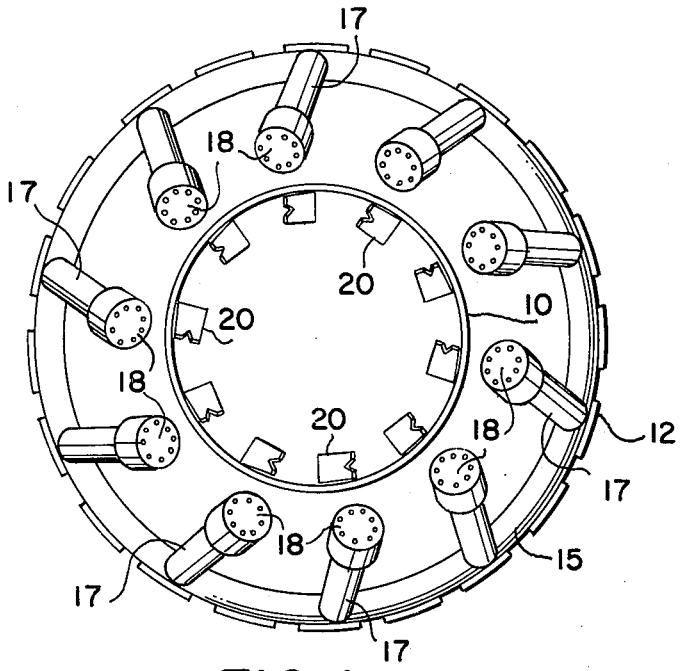
FIG. 1 is a top plan view of a flare stack having the flame retention apparatus of the invention incorporated therein.
Figure 2:
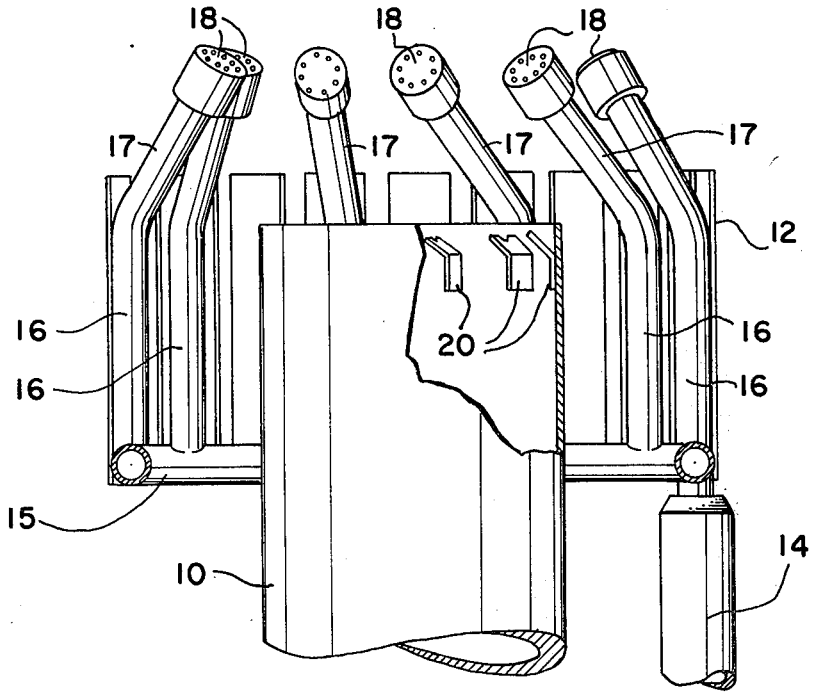
FIG. 2 is a view in elevation with part of the windshield and part of the stack broken away to show the details of construction.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

It is common practice to utilize a flare stack for the disposal of waste combustible gas from chemical and industrial processes, and particularly from oil refining.

Referring now more particularly to the drawings a flare stack 10 is shown circular in horizontal cross section. The flare stack 10 is of the desired diameter in accordance with the volume of the waste combustible gas to be burned and may range in diameter from 6 inches to 12 feet.

The flare stack 10 is shown, merely by way of illustration, as being provided at the top with a hollow cylindrical slotted windshield 12, closed at the bottom to protect the pilots (not shown) and to reduce the wind effect at the top of the stack 10.

The stack 10 is also shown as having a steam supply pipe 14 connected to a manifold 15 with a plurality of upwardly extending pipes 16 with their upper ends 17 angularly inclined from the horizontal and turned to direct steam in a vortex pattern around the burning gases. The upper ends 17 of the pipes 16 preferably have nozzles 18 of any desired type, those being shown in the U.S. Patent to Gordon M. Bitterlich et al., No. 3,463,602, being particularly suitable. While steam is used in many installations to produce smokeless combustion there are many other installations where steam is not available or the use of steam is not desired.

The guide vanes 20, employed in connection with the invention are shown in detail in FIGS. 3, 4, 5 and 6. The sizes of the vanes 20, their spacing, and their number are varied in accordance with the diameter of the top of the stack 10.

Each of the guide vanes 20 preferably includes a base portion 21 with side edges 22 and 23 and a bottom edge 24 and an upper portion 25 with a top edge 26 and side edges 27 and 28. The upper portion 25 is at an angle with respect to the base portion 21 along a line 29. The interior angle between the upper portion 25 and the base portion 21 is preferably in the range from 150° to 165°. The side edge 28 is tapered for accommodation to the interior surface of the stack 10.

The upper portion 25, dependent upon the width thereof, is provided with a number of notches 30 to separate spaced teeth 31 the width of the teeth 31 and of the notches 30 along the edge 26, tooth 31 and notch 30 each being of the order of ½ inch and the notches being of a depth of about ½ inch.

The side edges 22 and 23 are not required to be of the same length, the side edge 23, for attachment to the interior face of the stack 10 preferably being somewhat longer. The attachment of the vanes 20 to the interior face of the stack 10 is preferably by a line of welding 33.

The number of vanes 20 is varied in accordance with the size of the vanes 20 and the diameter of the stack 10, and for a 6 inch diameter stack 10, merely by way of illustration, eight vanes 20 can be employed while for a 48 inch stack seventy two vanes can be employed.

The dimensions of the vanes 20 can be varied and merely by way of illustration for a 6 inch stack 10, the width can be of the order of 1 inch with a length of the upper portion 22 being about 1 inch while for a 48 inch diameter stack 10 the width can be of the order of 4 inches and the length of the upper portion 25 can be of the order of $1\frac{1}{2}$ inches.

The mode of operation will now be pointed out.

Waste combustible gas advancing through the stack 10 for combustion at and beyond the end is ignited in any desired manner such as by one or more pilots. As the waste combustible gas reaches the guide vanes 20 the portion of the waste gas interiorly of the vanes continues its upward advance while the exterior portion of the order of 30% of the total flow is directed by the upper portion 25 of the vanes 20 in a swirling or vortex path with further turbulence induced by the teeth 31 and notches 30.

The exterior portions of the waste gas, guided by the vanes 20, provide better flame stability with smoother and greater waste gas flow not restricted as heretofore by a ring of reduced internal diameter which caused a reduced flow and an increased pressure drop.

There is also a reduced tendency to heating at the exit of the stack 10 with longer flame tip life.

The reduction in weight attendant on the use of the vanes 20 avoids the difficulties heretofore where the mass of the ring and its supporting stack lost strength upon heating causing structural failure.

I claim:

1. Flame retention apparatus for a flare stack which comprises a cylindrical flare stack having a central opening at the discharge end of the stack for outward waste combustible gas delivery for combustion, flame retention means at the discharge end of the stack comprising a plurality of guide vanes spaced around the interior periphery of the stack and for changing the direction of the external portions of the stream of waste combustible gas with respect to the remaining portion of the stream of waste combustible gas, the interior of the discharge end of said flare stack being unobstructed except for said vanes, each of said guide vanes having a base portion extending inwardly of for a distance of less than a quarter of the diameter of said stack and secured along one edge to the interior of the stack, said base portions extending longitudinally of said stack, and an upper portion disposed at an obtuse angle to the base portion and having an edge in juxtaposition with the internal periphery of said flare stack for directing external portions of advancing waste combustible gas in a vortex path around the remaining portion of the waste combustible gas for flame retention.

2. Flame retention apparatus as defined in claim 1 in which said upper portions have their upper edges provided with a plurality of teeth for increasing the turbulence of the gas advancing thereby.

3. Flame retention apparatus as defined in claim 1 in which said edge portions are retained by welding.

4. Flame retention apparatus as defined in claim 1 in which said upper portion of a guide vane is disposed at an angle in the range from 150° to 165° with respect to the base portion of the guide vane.

* * * * *